US005573277A

United States Patent [19]

Petkovsek

[11] Patent Number: 5,573,277

[45] Date of Patent: Nov. 12, 1996

[54] MAILPIECE AND/OR SHIPPING ITEM FOR SPECIAL MAILING AND A METHOD FOR ASSEMBLING A MAILPIECE AND/OR SHIPPING ITEM REQUIRING SPECIAL SERVICES

[75] Inventor: Glenn Petkovsek, 20 Tortoise Park Cove, Little Rock, Ark. 72211-2349

[73] Assignee: Gleen Petkovsek, Little Rock, Ark.

[21] Appl. No.: 281,634

[22] Filed: Jul. 28, 1994

Related U.S. Application Data

[63] Continuation-in-part of Ser. No. 206,018, Mar. 4, 1994, abandoned.

[51] Int. Cl.[6] ..... G09F 3/04

[52] U.S. Cl. ..... 283/79; 283/81; 283/101; 283/103; 462/26

[58] Field of Search ..... 283/79, 81, 101, 283/103; 462/6, 26; 229/300

[56] References Cited

U.S. PATENT DOCUMENTS 3,968,927 7/1976 Katz et al. ..... 229/70
4,418,865 12/1983 Bowen .
4,682,793 7/1987 Walz .
5,183,203 2/1993 Sanders ..... 283/81 X
5,190,210 3/1993 Walz .
5,267,898 12/1993 Doll et al. ..... 462/6

FOREIGN PATENT DOCUMENTS 1030577 5/1978 Canada ..... 283/81

OTHER PUBLICATIONS

United States Postal Service Forms: PS Forms 3800, 3804, 3811, Label 11–B.

*Primary Examiner*—Frances Han
*Attorney, Agent, or Firm*—Hill, Steadman & Simpson

[57] ABSTRACT

A two-sided label/form is provided for attaching portions thereof to a mailpiece or shipping item particularly for special service handling of the mailpiece or shipping item. A plurality of detachable parts are provided on a sheet for subsequent attachment to the mailpiece or shipping item following printing thereof. The label/form includes a number of adhesively-backed sections for selected attachment at selected areas of the mailpiece or shipping item to identify the mailpiece or shipping item and simplify the task of designating special services for a particular mailpiece or shipping item.

27 Claims, 4 Drawing Sheets

MAILPIECE AND/OR SHIPPING ITEM FOR SPECIAL MAILING AND A METHOD FOR ASSEMBLING A MAILPIECE AND/OR SHIPPING ITEM REQUIRING SPECIAL SERVICES

BACKGROUND OF THE INVENTION

This application is a continuation-in-part application of co-pending U.S. patent application Ser. No. 08/206,018 filed Mar. 4, 1994, now abandoned.

The present invention generally relates to a form for printing and addressing information relating to mail handling for attachment to a mailpiece. More specifically, the present invention relates to a two-sided multi-part form for special service handling of mailpieces or for mailpieces requiring special services.

It is, of course, known to provide specialized postal processing and handling of particular mailpieces. Such special services include the preparation of certified mail, registered mail, insured mail, recorded delivery mail, return receipt for merchandise mail, C.O.D. and the like. The known procedure requires printing or writing of information on various slips of paper and attaching the slips to the outside of an envelope or other mailpiece. Often carbon paper is used to assist in making the attachments.

As an example, to prepare a certified mailpiece, the forms are supplied by the United States Postal Service to the customer. The customer must separately address and complete a certified mailing receipt, both faces of a return receipt card, an envelope or mailpiece in which the mail is to be mailed, and a request for return service on the face of the envelope. Then, the customer or the Postal Service must affix each of the completed parts to the envelope using glue, an adhesive, tape or the like.

In U.S. Pat. No. 4,682,793 to Walz, a multiple-part mailer form assembly is shown in which the addressing of the multiple forms required for certified mail or other specialized postal handling may be accomplished by continuously fed impact-type printers. The parts are then separated from each other for affixing some parts to the outside to a standard window envelope which can be addressed by the insertion of one of the extra form layers.

This type of multiple-layer continuous assembly cannot be addressed or overprinted in the non-impact printers as commonly used or on less expensive impact-type printers having no means to adjust for strength of impact or thickness of multiple-layer forms. Furthermore, the address information printed on the intermediate or rear layers of such forms is often degraded or blurred to a less readable condition by the necessity of printing through the multiple layers. This degradation renders the use of bar codes unfeasible on the lower layers of the address inserts to be compatible with U.S. Postal Service sorting equipment which is now generally used. Further, the degradation renders unfeasible the use of high-density bar codes in other formats for automated identification of the return receipt postal card when returned to the sender as proof of delivery to the addressee.

Still further, the multiple-part mailer disclosed by Walz requires forms to be separately affixed to the outside of the envelope or other mailpiece by using glue, adhesive, tape, or the like. The form includes a significant amount of carrier, backing, carbon layer, peel-off or other materials which require handling and removal during use and subsequent discarding as waste after use. Further, chemical treatment of some of the layers of the form is also required during manufacturing of the form.

Still further, the mailer disclosed by Walz is not suitable for feeding through automatic non-impact printers and, therefore, the return address of the sender must be printed on the back of the return receipt card portion of the form by non-impact means, i.e. either hand-printing or labelling or offset printing during the manufacturing process. This avoids unwanted reverse printing on the face of the other layers. Finally, the mailer of Walz does not disclose a means for noting the request for return receipt service, if desired, on the face of the envelope as required by postal regulations.

Clearly, the current methods known for preparing mailpieces or shipping items for special services is tedious, complicated, and labor intensive, particularly for businesses and institutions in which items such as notifications, reminders, or valuable documents are commonly sent by specialized mail services. In many instances, the delivery of such mailpieces must be documented by recording of a U.S. Postal Service or other services return receipt when it arrives back to the sender. This task is also time-consuming and has great potential for error when all of the identifying information from each return receipt card must be entered or recorded by hand.

A need, therefore, exists for an improved form for special service mail and shipping handling and a method for assembling a mailpiece or shipping item requiring special services.

SUMMARY OF THE INVENTION

The present invention provides a label/form printed on two sides wherein portions of the label/form are attached to a sheet and including an adhesive on its back for attaching the same to a mailpiece or shipping item. Another portion of the sheet is detachable from the label/form for securing to the mailpiece and subsequent by design removal from the mailpiece or shipping item.

To this end, in an embodiment, the present invention provides a label/form for printing and addressing information relating to mail handling on a mailpiece. The label/form comprises a sheet and a plurality of detachable parts wherein at least of the plurality of detachable parts is removably secured to the sheet. An adhesive layer removably secures the at least one of the plurality of detachable parts to the sheet. An identifier on at least one of the plurality of detachable parts uniquely identifies the mailpiece.

In an embodiment, the identifier is a number. In another embodiment, the identifier is a bar code.

In an embodiment, the plurality of detachable parts comply with postal and shipping regulations for certified mail, registered mail, insured mail, recorded delivery mail and return receipt for merchandise mail, C.O.D. and shipping items.

In an embodiment, one of the plurality of detachable parts is a return receipt card, the return receipt card is laminated together with an adhesive layer tab on the right and left sides of the card.

In an embodiment, the information comprises at least a sending address and a return address.

In an embodiment, the sheet has a plurality of detachable parts for satisfying requirements for the mail and shipping handling of at least one or more mailpieces or shipping items.

In an embodiment, at least one or more parts of the plurality of detachable parts are provided for securing to the mailpiece or shipping item.

In an embodiment, the identifier has a background of a contrasting shade from at least a portion of the remainder of the plurality of detachable parts.

In another embodiment of the present invention, a two-sided special services mailing label/form for use on a mailpiece is provided. The label/form comprises a sheet having a first side and a second side, a first plurality of detachable parts on the first side secured to the first side by an adhesive.

In an embodiment, the two-sided special services mailing label/form further comprises an identifier on at least one of the detachable parts from the first plurality and the second plurality of detachable parts, the identifier uniquely identifying the mailpiece. In an embodiment, the identifier is machine-readable.

In an embodiment, the first plurality of parts and the second plurality of parts satisfy requirements for mail handling of at least one or more mailpieces.

In an embodiment, the portion of the second plurality of detachable parts is a return receipt card.

In an embodiment, the sheet is printed having backgrounds of at least two contrasting shades.

In another embodiment of the present invention, a method is provided for assembling a mailpiece requiring special services for the mailpiece or shipping item. The method comprises the steps of: providing a label/form printed on at least one or more sides of the sheet, the label/form having a plurality of detachable parts; removing a first part of the plurality of detachable parts from the sheet, the first part having an adhesive back for removable attachment to the sheet and subsequent attachment to the mailpiece or shipping item, the first part identifying a type of special service; attaching the first part to the mailpiece or shipping item; removing a second part of a plurality of detachable parts from the sheet, the second part having a portion thereof adhesively-backed for attachment to the mailpiece or shipping item and attaching the second part to the mailpiece or shipping item.

In an embodiment, the method further comprises the step of providing an identifier on at least the first part and the second part, the identifier uniquely identifying the mailpiece or shipping item. In an embodiment, the identifier is machine-readable.

In an embodiment, the method further comprises the steps of removing a third part of the plurality of detachable parts from the sheet, the third part having an adhesive backing for removable attachment to the sheet and subsequent attachment to the mailpiece or shipping item; and attaching the third part to the mailpiece or shipping item. In an embodiment, the third part includes information relating to delivery of the mailpiece or shipping item.

In an embodiment, a portion of the second part forms a return receipt card. In an embodiment, the second part is removed from the sheet by tearing at a perforated tear line.

In an embodiment, the method further comprises the step of printing the label/form with at least two contrasting background colors.

In another embodiment of the present invention, a mailpiece or shipping item is provided requiring special services for handling thereof. The mailpiece or shipping item comprises a first adhesively-backed section for attachment to the mailpiece or shipping item having a designation indicative of the special service. A partially adhesively-backed section attaches to the mailpiece or shipping item having a perforated tear line for removal of the non-adhesively-backed portion of the section from the mailpiece or shipping item.

In an embodiment, a second adhesively-backed section attaches to the mailpiece or shipping item.

In an embodiment, an identifier on the first adhesively-backed section and the partially adhesively-backed section is provided wherein the identifier uniquely identifies the mailpiece or shipping item.

It is, therefore, an advantage of the present invention to provide a label/form and a method for simplified assembly of a mailpiece or shipping item requiring special services.

Another advantage of the present invention is to provide a label/form and a method for identifying the type of special service by removal of a portion of the label/form from a sheet and subsequent attachment to a mailpiece or shipping item.

Yet another advantage of the present invention is to provide a label/form and a method for assembly of a mailpiece or shipping item requiring special services such that the label/form and the method can be quickly performed.

A still further advantage of the present invention is to provide a label/form and a method for assembling a mailpiece or shipping item using the label/form without requiring additional means for securing the label/form to the mailpiece or shipping item.

And, another advantage of the present invention is to provide a label/form that simplifies identification of particular sections thereof for both machine readability and visible identification.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
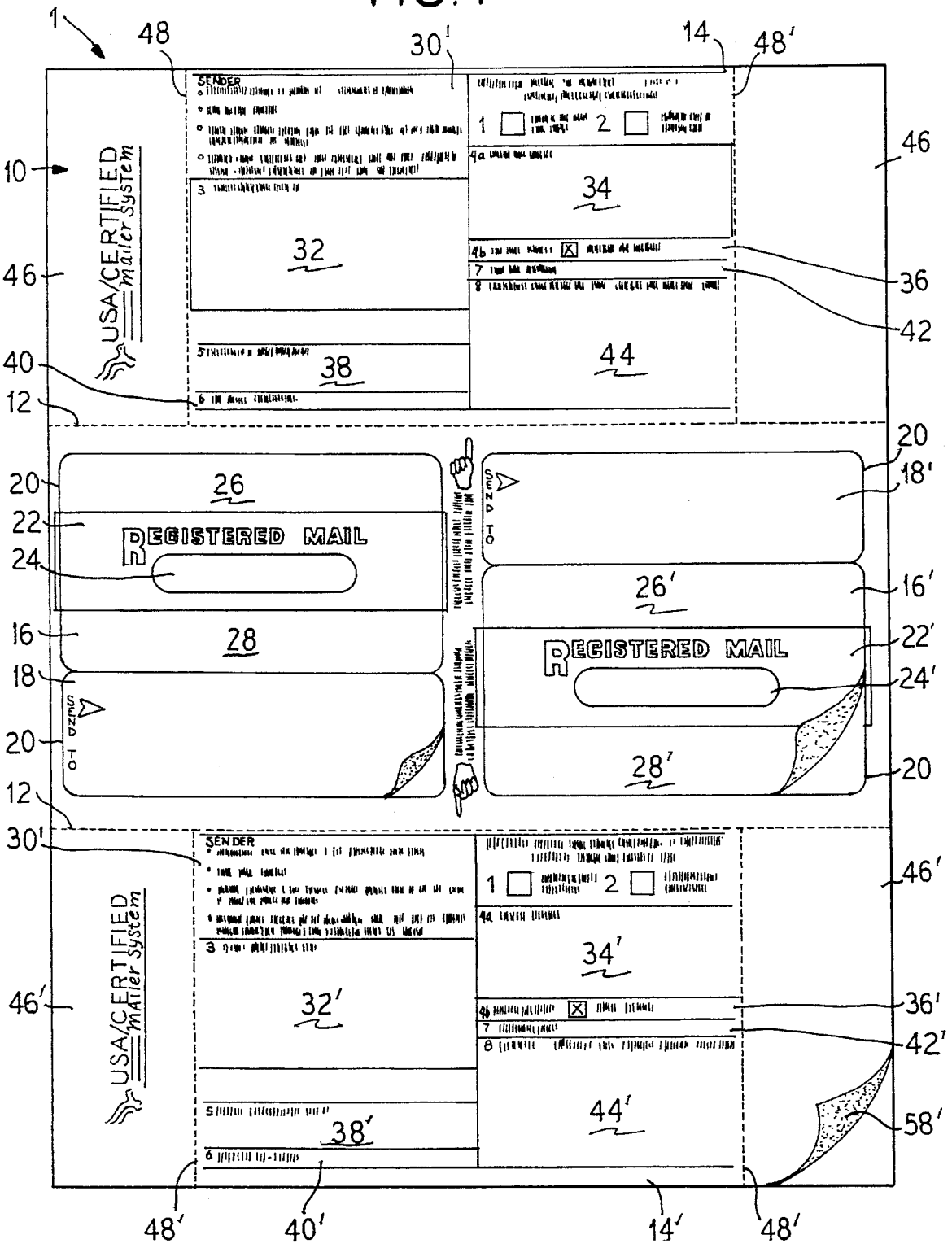
FIG. 1 illustrates a plan view of an embodiment of one side of a label/form for special service mailing/shipping of a mailpiece or shipping item.

Referring now to the drawings, wherein like numerals refer to like parts, a special service mailing label/form is generally illustrated at 1. The label/form 1 consists of a plurality of detachable parts. Some of the parts of the label/form 1 are detachable by tear lines, while other portions of the label/form 1 are attached to the sheet by an adhesive on the back of the portion.

FIG. 1 illustrates a first side 10 of the label/form 1. The first side 10 has two sets of detachable parts for satisfying requirements for mailing/shipping of at least one mailpiece or shipping item requiring special services. It should be understood, however, that a particular label/form may be infinite in length satisfying the requirements for any number of mailpieces or shipping items requiring special services. In the alternative, the label/form may be designed such that it satisfies requirements for labeling and special services for a single mailpiece or shipping item. Still further, the label/form illustrated is for registered mail, however, any type of special service mailing or shipping may be satisfied with the present invention, including, but not limited to, registered mail, insured mail, recorded delivery, return receipt for merchandise, C.O.D., etc.

The label/form 1 illustrated in FIG. 1 has two horizontal perforated tear lines 12 for removal of return receipt card sections 14 and 14' from the remainder of the label/form 1. A second set of parts are adhesively-backed to the label/form 1 for removable attachment to the label/form 1 and subsequent attachment to the mailpiece or shipping item. Service identifier sections 16 and 16' are attached to the label/form 1 by an adhesive backing. Sender identifier sections 18 and 18' are similarly adhesively-backed to the label/form 1. The service identifier sections 16 and 16' and the sender identifier sections 18 and 18' have score lines 20 generally defining each of the sections and for simplified removal of the sections 16, 16', 18, and 18' from the label/form 1.

The service identifier sections 16 and 16' include a first special service identifier 22 and 22', respectively. The special service identifiers 22, 22' may be distinctly colored from the remainder of the service identifier sections 16, 16'. Still further, letters may be imprinted on the service identifier sections 16, 16' indicating the particular type of special service, such as the "REGISTERED MAIL" identifier.

Contrasting colored sections 24, 24' are provided within the special service identifiers 22, 22' of the service identifier sections 16, 16'. The contrasting colored sections 24, 24' may be printed with an identifier such as an article number and/or may be further printed with variable specific instructions such as "RETURN RECEIPT REQUESTED" or other imprinting as desired.

Figure 4:
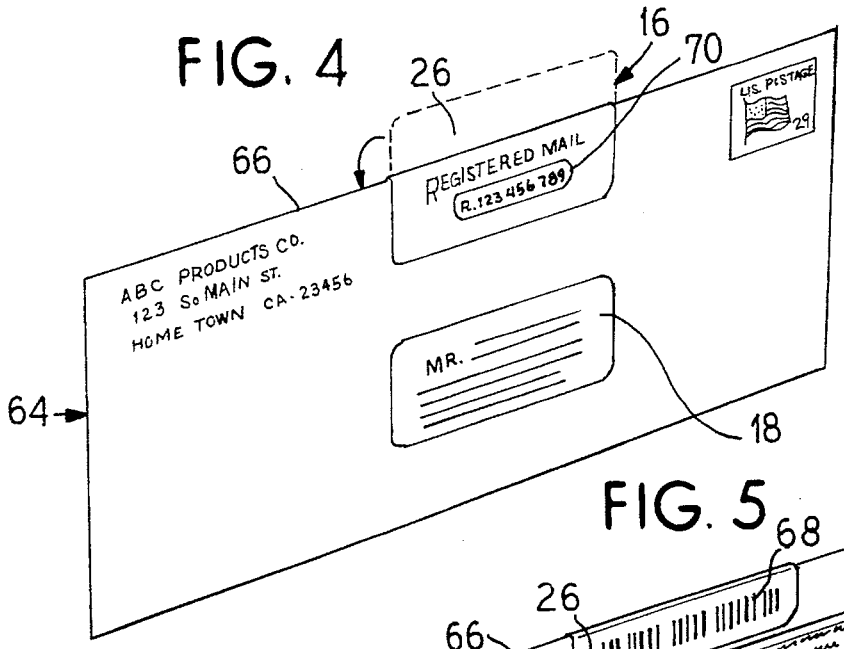
FIG. 4 illustrates a perspective view of an embodiment of one side of a mailpiece or shipping item with attachment of a portion of the label/form required for special service mail or shipment handling of the mailpiece or shipping item.

Top sections 26, 26' and bottom sections 28, 28' are provided on opposite sides of the special service identifiers 22, 22' for additional space for printing in label/formation as desired or, alternatively, may be left unprinted or blank. The top sections 26, 26' are particularly suitable for printing of bar codes, OCR type or other machine-readable images. The top sections 26, 26' are inverted when sealed onto the mailpiece or shipping item (as illustrated in FIG. 4) such that a back side of the mailpiece or shipping item includes the identifier associated with the mailpiece or shipping item.

The return receipt card sections 14, 14' on the first side 10 of the label/form 1 are removably attached to the label/form 1 by the perforated tear lines 12. The return receipt card sections 14, 14' include instruction sections 30, 30', article addressee sections 32, 32', article number or identifier sections 34, 34', service type sections 36, 36', addressee signature sections 38, 38', and agent signature sections 40, 40'. Further, date of delivery sections 42, 42' and addressee's address sections 44, 44' are provided. This particular label/form is suitable for a return receipt card for registered mail and other special service mail and shipping items. Of course, similar type receipt cards capable of providing a return receipt following delivery of the mailpiece or shipping item may be implemented.

Any one or more of the aforementioned sections may be of contrasting color to the main background color of the remainder of the label/form 1. For instance, typically, the background color of the return receipt card sections 14, 14' may be a green shade commonly used for return receipt cards. The identifier sections 34, 34' may have a white background for simplified reading of, for example, a bar code or OCR characters printed thereon. Likewise, the article addressee sections 32,32' may be printer with a white background for immediate recognition on the label/form 1 of the delivery point of the mailpiece or shipping item carrying the label/form 1. The central portion of the label/form 1 including the service identifier sections 16,16' and the sender identifier sections 18,18' may be similarly shaded with contrasting colors for identification and machine readability purposes of the bar codes and/or OCR characters or the like.

Figure 5:
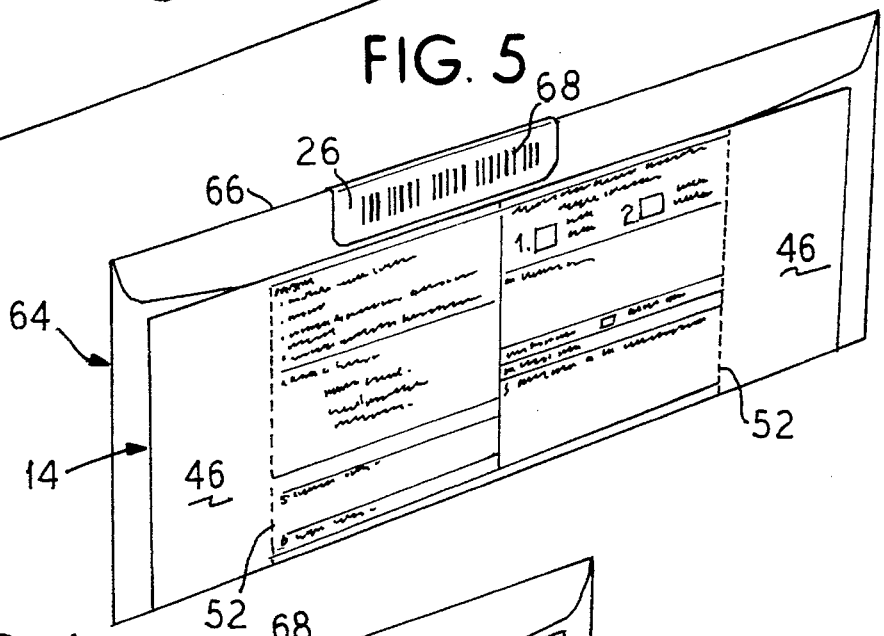
FIG. 5 illustrates a plan view of an embodiment of a second side of a mailpiece or shipping item with a second portion of the label/form required for special service handling of the mailpiece or shipment attached to the mailpiece or shipping item.

Peelable sections 46 and 46' are provided a silicone layer 56' and an adhesive layer 58' for removably detaching the back side of the label/form 1 from the return receipt card and subsequent attachment to the mailpiece or shipping item as illustrated in FIG. 5. To this end, that portion of the return receipt card sections 14, 14' on the first side 10 of the label/form 1 is attached in its entirety to the mailpiece or shipping item. Vertical perforated lines 52, 52' are provided for subsequent detachment of the return receipt card from the mailpiece or shipping item (as illustrated in FIG. 6).

Figure 2:
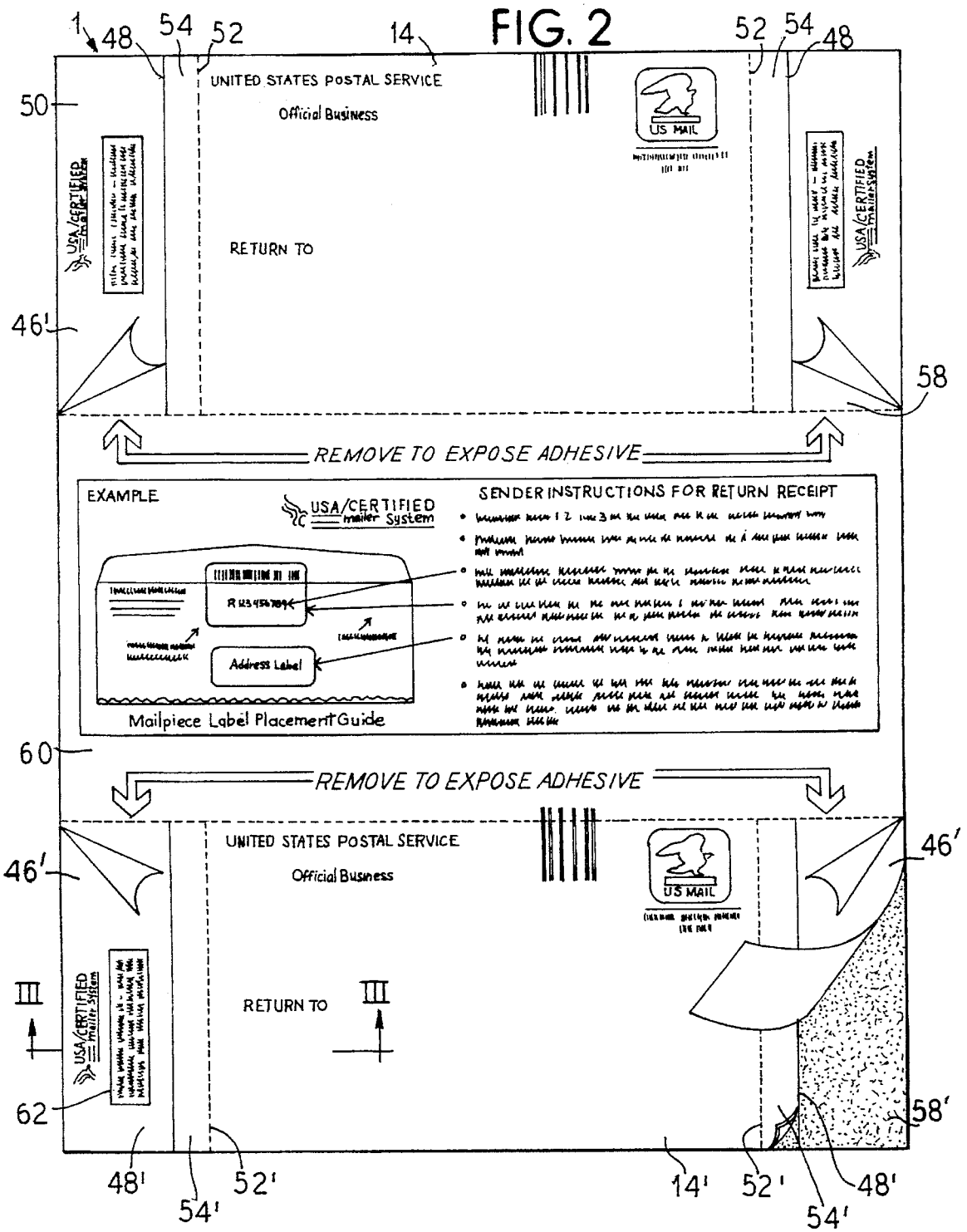
FIG. 2 illustrates a plan view of an embodiment of a second side of a label/form for special service mailing/shipping of a mailpiece or shipping item.
Figure 3:
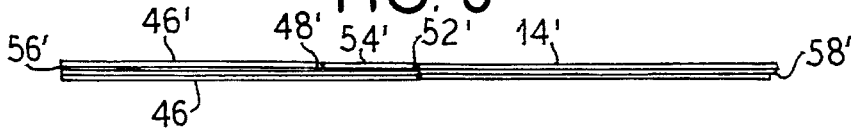
FIG. 3 illustrates a partial cross-sectional view taken generally along the line III—III of FIG. 2.

Referring now to FIG. 2, a back side 50 of the label/form 1 is illustrated. The back side 50 includes front faces of the return receipt card sections 14, 14'. The vertical perforated tear lines 52, 52' are further provided inside of vertical slit lines 48, 48'. The area between the vertical slit lines 48, 48' and the vertical perforated tear lines 52, 52' define tying together sections 54, 54'. The tying together sections 54, 54' include an area having a back having a partial section thereof containing the adhesive layer 58, 58' as illustrated in FIGS. 2 and 3. That is, the adhesive layer 58, 58' from the peelable sections 46, 46' continues into the tying together sections 54, 54' for securing the return receipt card sections 14, 14' thereto.

The adhesive layers 58, 58' are provided to prevent separation of the layers of the return receipt card label/forming the front side and the back side thereof. A central section 60 is provided on the back side 50 including instructions for assembling the label/form onto the mailpiece or shipping item. Additional instructions may be provided on the peelable sections 46, 46' as generally illustrated at 62.

Figure 6:
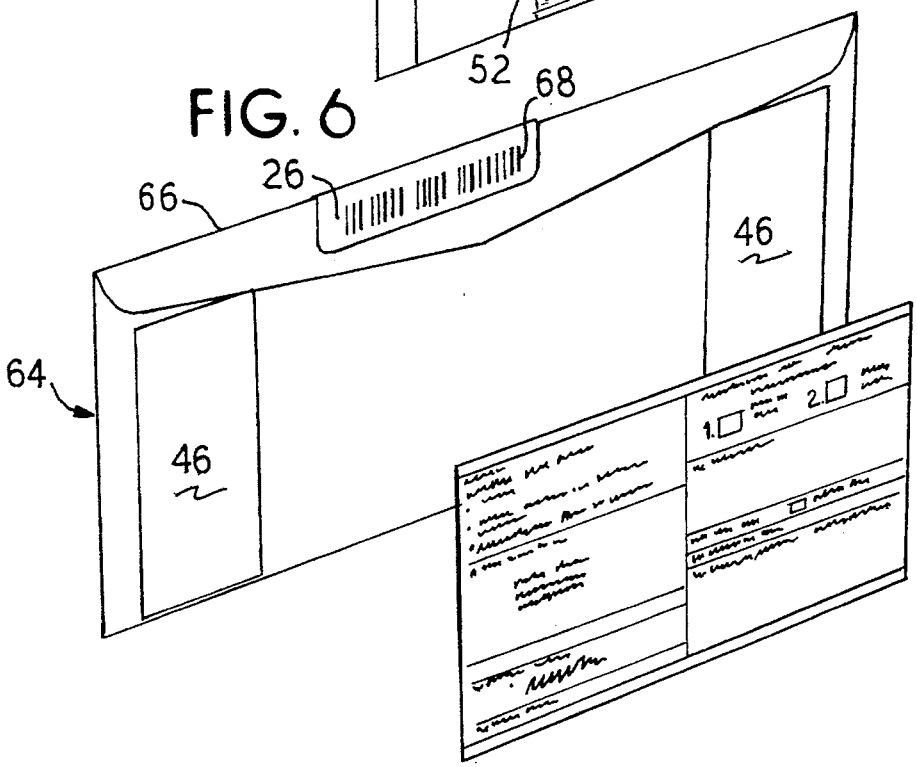
FIG. 6 illustrates a perspective view of an embodiment of a second side of the mailpiece or shipping item with a portion of the second part of the label/form detached from the mailpiece or shipping item.

The assembling of a mailpiece or shipping item 64 with the respective portions of the label/form 1 is more clearly illustrated in FIGS. 4–6. To assemble the mailpiece or shipping item 64, a sender identifier section 18 is first removed from the first side 10 of the label/form 1 and centered onto the mailpiece or shipping item 64. Then, following printing of the requisite information onto each of the individual sections, the service identifier section 16 is attached at a top edge 66 of the mailpiece or shipping item 64. The section of the service identifier section 16 referred to as the top section 26 is inverted to face on the back side of the mailpiece or shipping item 64 as illustrated in FIGS. 5 and 6. The top section 26 may include a machine readable identifier 68 corresponding to the numerical identifier 70 on a front side of the mailpiece or shipping item 64. Then, the return receipt card section 14 may be attached to a back side of the mailpiece or shipping item 64 by removing the peelable sections 46 such that the adhesive layer 58, 58' on the underside of the sections 46 is placed on the back side of the mailpiece or shipping item 64. As a result, the return receipt card section 14 is attached to the back side of the mailpiece of shipping item 64.

Following delivery of the mailpiece or shipping item 64, the return receipt card of the return receipt card section 14 may be detached along the vertical perforated tear lines 52 separating the return receipt card from the remainder of the mailpiece or shipping item 64. The peelable sections 46 maintain their adhesion to the back side of the mailpiece or shipping item 64 as shown in FIG. 6.

Figure 7:
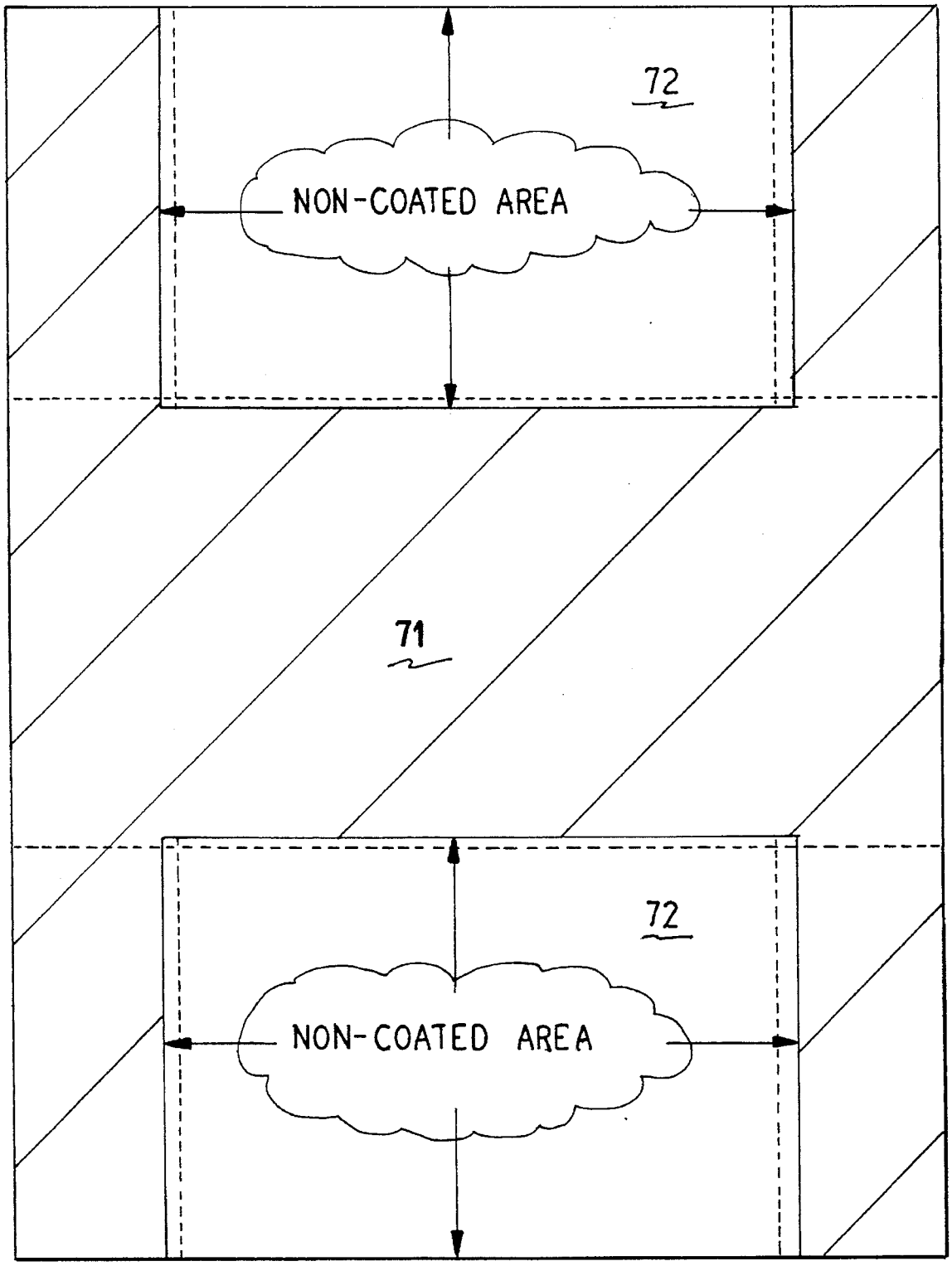
FIG. 7 illustrates a plan view of the label/form of the present invention designating the areas of the label/form having coated and non-coated areas of adhesive.

As illustrated in FIG. 7, the area generally designated at 71 includes the silicone layer 56 or 56' and the adhesive layer 58 or 58', respectively, providing the necessary peelability of layers of the label/form 1. The non-coated areas generally designated at 72 include only the adhesive layer preventing peelability between the layers label/formed by the front side and the back side of the label/form 1 resulting in label/formation of the return receipt card 14. The combination of the adhesive layer 58 with the silicone layer 56 also prevents or inhibits migration of the adhesive layer 58 along edges, perforations, and/or slits of the label/form 1.

Of course this particular arrangement is suitable for many types of mailpiece or shipping items requiring special service and for a variety of mailpiece or shipping items requiring special service mailing. Therefore, the present invention is not to be construed or limited to registered mail on a standard size envelope as illustrated in FIG. 4–6, but should rather encompass any type of mailpiece or shipping item requiring any type of special service, particular those requiring a return receipt or other acknowledgement of receipt of the mailpiece or shipping item.

Furthermore, printing of the label/form may be conducted in any known manner, such as by hand, by feeding the sheet through a printer, or by a continuously fed printer either an impact or a non-impact type. The present invention is not to be limited in the manner in which the label/form itself is printed as the same may be implemented by those skilled in the art.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A label/form for printing and addressing information relating to mail and shipping handling on a mailpiece or shipping item, the label/form comprising:

a multi-layer sheet, each layer having a front side and a back side wherein only the front side of a first layer and the back side of a second layer of the multi-layer sheet receive the information and further wherein the front side of the first layer and the back side of the second layer of the multi-layer sheet has a plurality of distinct sections vertically displaced from one another;

a plurality of parts associated with the multi-layer sheet wherein at least one of the plurality of parts is non-removably secured to the multi-layer sheet and at least one other of the plurality of parts in each of the plurality of distinct sections is removably secured to the sheet having an adhesive backing;

an adhesive layer on the back side of the first layer for removably securing at least one of the plurality of parts from the front side of the first layer of the multi-layer sheet; and an identifier on at least one of the plurality of parts uniquely identifying the mailpiece or shipping item.

2. The label/form of claim 1 wherein the identifier is a number.

3. The label/form of claim 1 wherein the identifier is a bar code.

4. The label/form of claim 1 wherein the plurality of parts comply with postal regulations for certified mail, registered mail, insured mail, recorded delivery mail, return receipt for merchandise mail, C.O.D., or shipping item.

5. The label/form of claim 1 wherein one of the plurality of parts is a return receipt card, the return receipt card being laminated together.

6. The label/form of claim 1 wherein the information comprises at least a sending address and a return address.

7. The label/form of claim 1 wherein the sheet has a plurality of detachable parts for satisfying requirements for the mail and shipping handling of at least one mailpiece or shipping item.

8. The label/form of claim 1 wherein at least one detachable part is provided for securing to the mailpiece or shipping item.

9. The label/form of claim 1 wherein the identifier has a background of a contrasting shade from at least a portion of the remainder of the plurality of parts.

10. A two-sided special services mailing or shipping label/form for use on a mailpiece or shipping item comprising:

a multi-layer sheet, each layer having a first side and a second side wherein only the first side of a first layer and the second side of a second layer of the multi-layer sheet receive printed information related to the mailing and further wherein the first side of the first layer and the second side of the second layer of the multi-layer sheet has a plurality of distinct sections vertically displaced from one another;

a first plurality of parts on the first side of the first layer removably secured to the first side of the second layer by an adhesive on the second side of the first layer of each of the plurality of distinct sections, at least one of the first plurality of parts identifying a type of special service; and a second plurality of parts associated with the multi-layer sheet wherein at least a portion of the second plurality of parts is non-removably attached to the multi-layer sheet.

11. The two-sided special services mailing or shipping label/form of claim 10 further comprising:

an identifier on at least one of the parts from the first plurality and the second plurality of parts, the identifier uniquely identifying the mailpiece or shipping item.

12. The two-sided special services mailing or shipping label/form of claim 11 wherein the identifier is machine-readable.

13. The two-sided special services mailing or shipping label/form of claim 10 wherein the first plurality of parts and the second plurality of parts satisfy requirements for mail shipment handling of at least one mailpiece or shipping item.

14. The two-sided special services mailing or shipping label/form of claim 10 wherein the portion of the second plurality of parts is a return receipt card.

15. The two-sided special services mailing or shipping label/form of claim 10 wherein the sheet is printed having backgrounds of at least two contrasting shades.

16. A method for assembling a mailpiece or shipping item requiring special services for the mailpiece or shipping item, the method comprising the steps of:

providing a label/form printed only on a front side and a back side of a multi-layer sheet wherein layers of the multi-layer sheet are adhered to form the front side and the back side, the label/form having a plurality of detachable parts in a plurality of distinct sections vertically displaced from one another;

removing a first part of the plurality of detachable parts from the multi-layer sheet, the first part having an adhesive back for removable attachment to the multi-layer sheet and subsequent attachment to the mailpiece or shipping item, the first part identifying a type of special service;

attaching the first part to the mailpiece or shipping item;

removing a second part of the plurality of detachable parts from the multi-layer sheet, the second part having a portion thereof adhesively-backed for attachment to the mailpiece or shipping item; and attaching the second part to the mailpiece or shipping item.

17. The method of claim 16 further comprising the step of:

providing an identifier on at least the first part and the second part, the identifier uniquely identifying the mailpiece or shipping item.

18. The method of claim 17 wherein a portion of the second part forms a return receipt card.

19. The method of claim 17 wherein the second part is removed from the sheet by tearing at a perforated tear line.

20. The method of claim 17 wherein the identifier is machine-readable.

21. The method of claim 17 further comprising the steps of:

removing a third part of the plurality of detachable parts from the sheet, the third part having an adhesive backing for removable attachment to the sheet and subsequent attachment to the mailpiece or shipping item; and attaching the third part to the mailpiece or shipping item.

22. The method of claim 21 wherein the third part includes information relating to delivery of the mailpiece or shipping item.

23. The method of claim 16 further comprising the step of:

printing the label/form with at least two contrasting background colors.

24. A mailpiece or shipping item requiring special services for handling thereof, the mailpiece or shipping item comprising:

a multi-layer sheet, each layer having a front side and a back side wherein only the front side of a first layer and the back side of a second layer of the multi-layer sheet receive printed information and further wherein the front side of the first layer and the back side of the second layer of the multi-layer sheet has a plurality of distinct components vertically displaced from one another;

a first adhesively-backed section on the back side of the first layer in each of the plurality of distinct components for attachment to the mailpiece or shipping item having a designation indicative of the special service; and a partially adhesively-backed section on the back side of the first layer associated with the multi-layer sheet including a non-adhesively backed portion for attachment to the mailpiece or shipping item having perforated tear lines for removal of the non-adhesively-backed portion of the section from the mailpiece or shipping item.

25. The mailpiece or shipping item of claim 24 further comprising:

a second adhesively-backed section for attachment to the mailpiece or shipping item.

26. The mailpiece or shipping item of claim 24 further comprising:

an identifier on the first adhesively-backed section and the partially adhesively-backed section, the identifier uniquely identifying the mailpiece or shipping item.

27. The mailpiece or shipping item of claim 24 wherein the special services include certified mail, registered mail, insured mail, recorded delivery and return receipt for merchandise, and C.O.D.

* * * * *

US005573277B1

REEXAMINATION CERTIFICATE (3699th)

United States Patent [19]

[11] B1 5,573,277

Petkovsek

[45] Certificate Issued Dec. 29, 1998

[54] MAILPIECE AND/OR SHIPPING ITEM FOR SPECIAL MAILING AND A METHOD FOR ASSEMBLING A MAILPIECE AND/OR SHIPPING ITEM REQUIRING SPECIAL SERVICES

[76] Inventor: Glenn Petkovsek, 20 Tortoise Park Cove, Little Rock, Ark. 72211-2349

Reexamination Request:
No. 90/004,937, Mar. 10, 1998

Reexamination Certificate for:

| | |
|---|---|
| Patent No.: | **5,573,277** |
| Issued: | **Nov. 12, 1996** |
| Appl. No.: | **281,634** |
| Filed: | **Jul. 28, 1994** |

Related U.S. Application Data

[63] Continuation-in-part of Ser. No. 206,018, Mar. 4, 1994, abandoned.

[51] Int. Cl.[6] ..... G09F 3/04

[52] U.S. Cl. ..... 283/79; 283/81; 283/101; 283/103; 462/26

[58] Field of Search ..... 283/79, 81, 101, 283/103; 462/6, 26; 229/300

[56] References Cited

U.S. PATENT DOCUMENTS

| | | |
|---|---|---|
| 2,805,816 | 9/1957 | Morgan . |
| 4,368,903 | 1/1983 | Jones . |
| 4,809,905 | 3/1989 | Goodman . |
| 4,983,438 | 1/1991 | Jameson . |
| 5,190,210 | 3/1993 | Walz . |
| 5,267,898 | 12/1993 | Doll et al. . |
| 5,316,208 | 5/1994 | Petkovsek . |
| 5,383,686 | 1/1995 | Laurash . |

*Primary Examiner*—Frances Han

[57] ABSTRACT

A two-sided label/form is provided for attaching portions thereof to a mailpiece or shipping item particularly for special service handling of the mailpiece or shipping item. A plurality of detachable parts are provided on a sheet for subsequent attachment to the mailpiece or shipping item following printing thereof. The label/form includes a number of adhesively-backed sections for selected attachment at selected areas of the mailpiece or shipping item to identify the mailpiece or shipping item and simplify the task of designating special services for a particular mailpiece or shipping item.

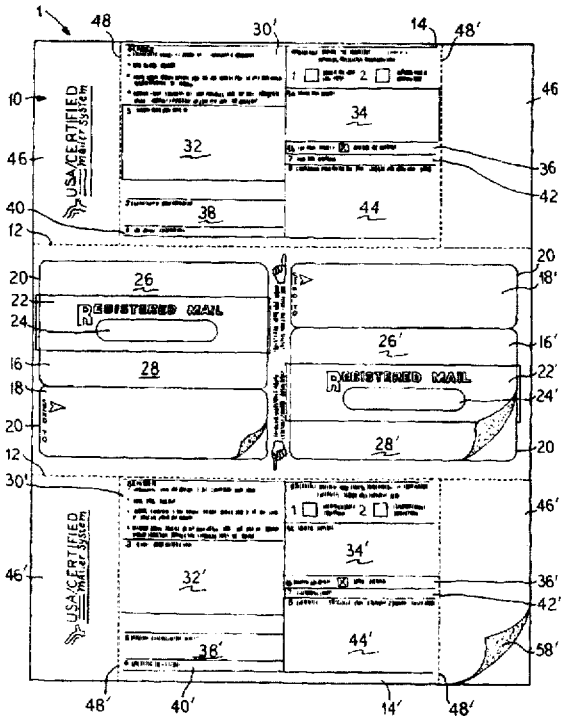

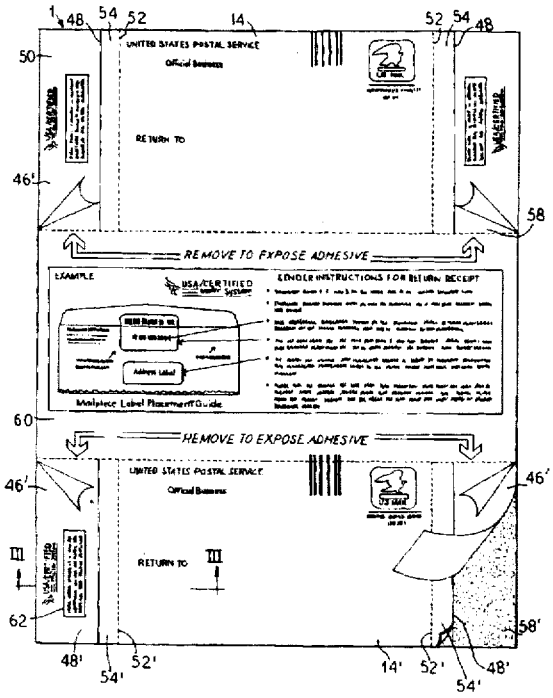

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–27 is confirmed.

* * * * *

US005573277B2

REEXAMINATION CERTIFICATE (4066th)

United States Patent [19] [11] B2 5,573,277

Petkovsek [45] Certificate Issued Apr. 25, 2000

[54] MAILPIECE AND/OR SHIPPING ITEM FOR SPECIAL MAILING AND A METHOD FOR ASSEMBLING A MAILPIECE AND/OR SHIPPING ITEM REQUIRING SPECIAL SERVICES

[75] Inventor: Glenn Petkovsek, 20 Tortoise Park Cove, Little Rock, Ark. 72211-2349

[73] Assignee: Glenn Petkovsek, Little Rock, Ark.

Reexamination Request:
No. 90/005,205, Dec. 30, 1998

Reexamination Certificate for:

| | |
|---|---|
| Patent No.: | **5,573,277** |
| Issued: | **Dec. 29, 1998** |
| Appl. No.: | **08/281,634** |
| Filed: | **Jul. 28, 1994** |

Reexamination Certificate B1 5,573,277 issued Nov. 12, 1996

Related U.S. Application Data

[63] Continuation-in-part of application No. 08/206,018, Mar. 4, 1994, abandoned.

[51] Int. Cl.[7] ..... B42D 15/00

[52] U.S. Cl. ..... 283/79; 283/81; 283/101; 283/103; 462/26

[58] Field of Search ..... 283/79, 81, 101, 283/103; 462/6, 26; 229/360

[56] References Cited

U.S. PATENT DOCUMENTS 5,267,898 12/1993 Doll et al. .
5,836,622 11/1998 Fabel .

*Primary Examiner*—Willimon Fridie, Jr.

[57] ABSTRACT

A two-sided label/form is provided for attaching portions thereof to a mailpiece or shipping item particularly for special service handling of the mailpiece or shipping item. A plurality of detachable parts are provided on a sheet for subsequent attachment to the mailpiece or shipping item following printing thereof. The label/form includes a number of adhesively-backed sections for selected attachment at selected areas of the mailpiece or shipping item to identify the mailpiece or shipping item and simplify the task of designating special services for a particular mailpiece or shipping item.

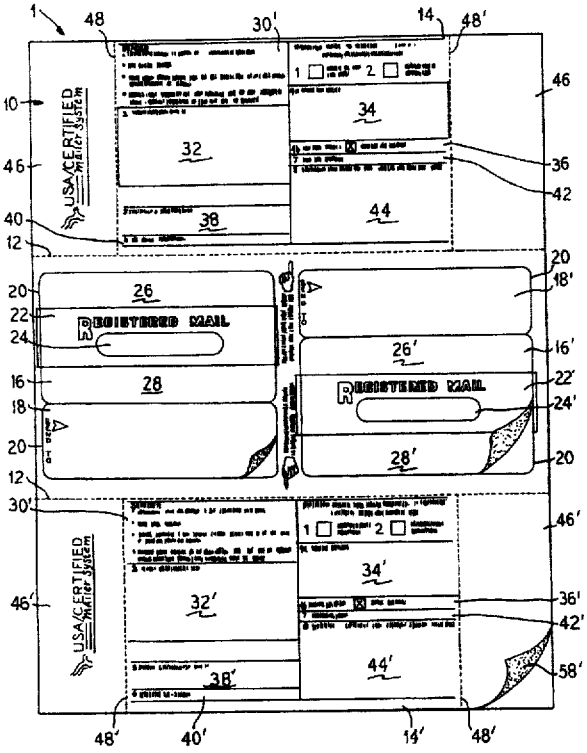

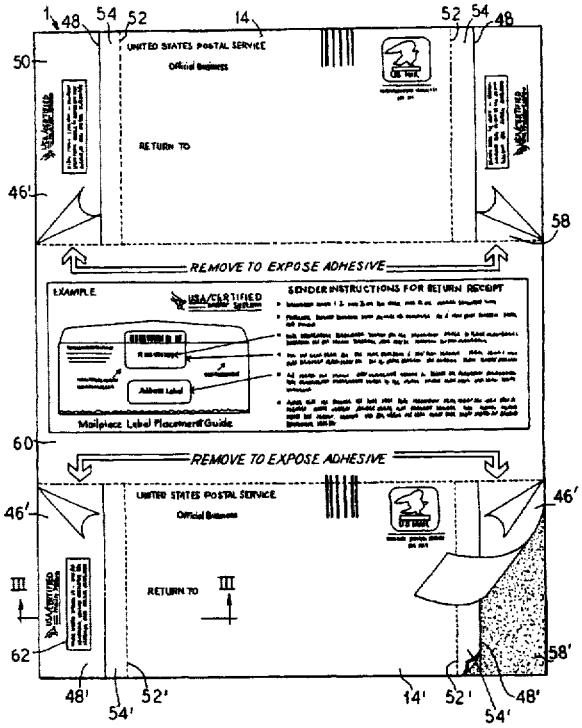

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–27 is confirmed.

* * * * *